US006010581A

United States Patent [19]

Rosén et al.

[11] Patent Number: 6,010,581

[45] Date of Patent: Jan. 4, 2000

[54] AUSTENITIC NI-BASED ALLOY WITH HIGH CORROSION RESISTANCE, GOOD WORKABILITY AND STRUCTURE STABILITY

[75] Inventors: Jonas Rosén, Sandviken; Lars Nylöf, Gävle; Sven Larsson, Årsunda, all of Sweden

[73] Assignee: Sandvik AB, Sandviken, Sweden

[21] Appl. No.: 09/030,399

[22] Filed: Feb. 25, 1998

Related U.S. Application Data

[63] Continuation of application No. 08/443,668, May 18, 1995, abandoned.

[30] Foreign Application Priority Data

May 18, 1994 [SE] Sweden ..... 9401695

[51] Int. Cl.[7] ..... C22C 19/05

[52] U.S. Cl. ..... 148/428; 148/427; 420/448; 420/450; 420/453; 165/180

[58] Field of Search ..... 420/448, 450, 420/451, 453; 148/410, 427, 428; 138/142, 143; 165/180, 133, 134.1

[56] References Cited

U.S. PATENT DOCUMENTS

| | | |
|---|---|---|
| 3,069,258 | 12/1962 | Haynes . |
| 3,160,500 | 12/1964 | Eiselstein et al. . |
| 3,510,294 | 5/1970 | Bieber et al. . |
| 4,400,211 | 8/1983 | Kudo et al. . |
| 4,400,349 | 8/1983 | Kudo et al. . |
| 4,421,571 | 12/1983 | Kudo et al. . |
| 4,685,427 | 8/1987 | Tassen et al. . |
| 4,765,956 | 8/1988 | Smith et al. . |
| 4,788,036 | 11/1988 | Eiselstein et al. . |
| 5,324,595 | 6/1994 | Rosen . |

FOREIGN PATENT DOCUMENTS

| | | |
|---|---|---|
| 60-211030 | 10/1985 | Japan . |
| 63-278690 | 11/1988 | Japan . |
| 6-306553 | 11/1994 | Japan . |
| 7003368 | 1/1995 | Japan . |

OTHER PUBLICATIONS

R.B. Frank & T.A. DeBold; "A New Age Hardenable Corrosion–Resistant Alloy"; ASM Materials Conference, Oct. 7, 1986; published Dec.

*Primary Examiner*—Deborah Yee
*Attorney, Agent, or Firm*—Burns, Doane, Swecker & Mathis, L.L.P.

[57] ABSTRACT

An austenitic Ni-based alloy with improved workability, good corrosion resistance and good structure stability useful as heat exchanger tubing in sulphur-, chloride- or alkaline-containing environments. The material has an austenitic structure which contains in weight-% up to 0.025% C, 20–27% Cr, 8–12% Mo, up to 0.5% Si, up to 0.5% Mn, up to 0.3% Al, up to 0.1% N, 3–15% Fe, up to 0.5% Ti, up to 0.5% Nb, the remainder being Ni and usual impurities.

4 Claims, 9 Drawing Sheets

AUSTENITIC NI-BASED ALLOY WITH HIGH CORROSION RESISTANCE, GOOD WORKABILITY AND STRUCTURE STABILITY

This application is a continuation of application Ser. No. 08/443,668 , filed May 18, 1995, now abandoned.

FIELD OF THE INVENTION

The present invention relates to an austenitic Ni-based alloy useful as construction material having high corrosion resistance, good hot workability, good tensile strength and structure stability.

BACKGROUND OF THE INVENTION

Normally low alloyed steels are used in waste incineration boilers. It is a well known problem that severe corrosion problems occur in such furnaces. It is a normal method primarily in the U.S.A. to protect such low alloyed material by overlay-welding a highly alloyed layer of a material such as A 625 which has been found to reduce the corrosion problems considerably. However, such overlay welding is not practically useful for tubes that are not used as panels such as super-heaters. An alternative to overlay-welding is the usage of composite tubes in which A 625 is used as an external layer. This should result in a good product from a corrosive aspect. However, such tubes are difficult to manufacture due to the large deformation forces that need to be used in hot working. The material is also sensitive to crack formation during cold working.

It is a complex challenge to provide a Ni-based alloyed material with good corrosion resistance and simultaneously good workability. However, by carrying out a systematic development work it has now been possible to provide a Ni-based alloy material that in a surprising manner can bring optimal properties in regard of corrosion resistance combined with hot workability, tensile strength and structure stability. By achieving these material properties, such material becomes useful not only as an external component in tubes for waste combustion furnaces but also as material used in black liquor recovery boilers, coal gasification, etc.

SUMMARY OF THE INVENTION

It is an object of the invention to avoid or alleviate the problems of the prior art.

It is a further object of the invention to provide an improved Ni-based alloy having corrosion resistance and hot workability.

According to a preferred embodiment, the invention provides a Ni-based alloy having an austenitic microstructure and containing, in weight-%:

| | | |
|---|---|---|
| C | up to | 0.025%, |
| Cr | | 20–27%, |
| Mo | | 8–12%, |
| Si | up to | 0.5%, |
| Mn | up to | 0.5%, |
| Al | up to | 0.3%, |
| N | up to | 0.1%, |
| Fe | | 3–15%, |
| Ti | up to | 0.5%, |
| Nb | up to | 0.5%, and |

a balance of Ni and unavoidable impurities, Cr and Mo being present in amounts such that $45 \leqq (\%\ Cr)+3\times(\%\ Mo) \leqq 57$.

DETAILED DESCRIPTION OF THE PREFERRED EMBODIMENTS OF THE INVENTION

Figure 1:
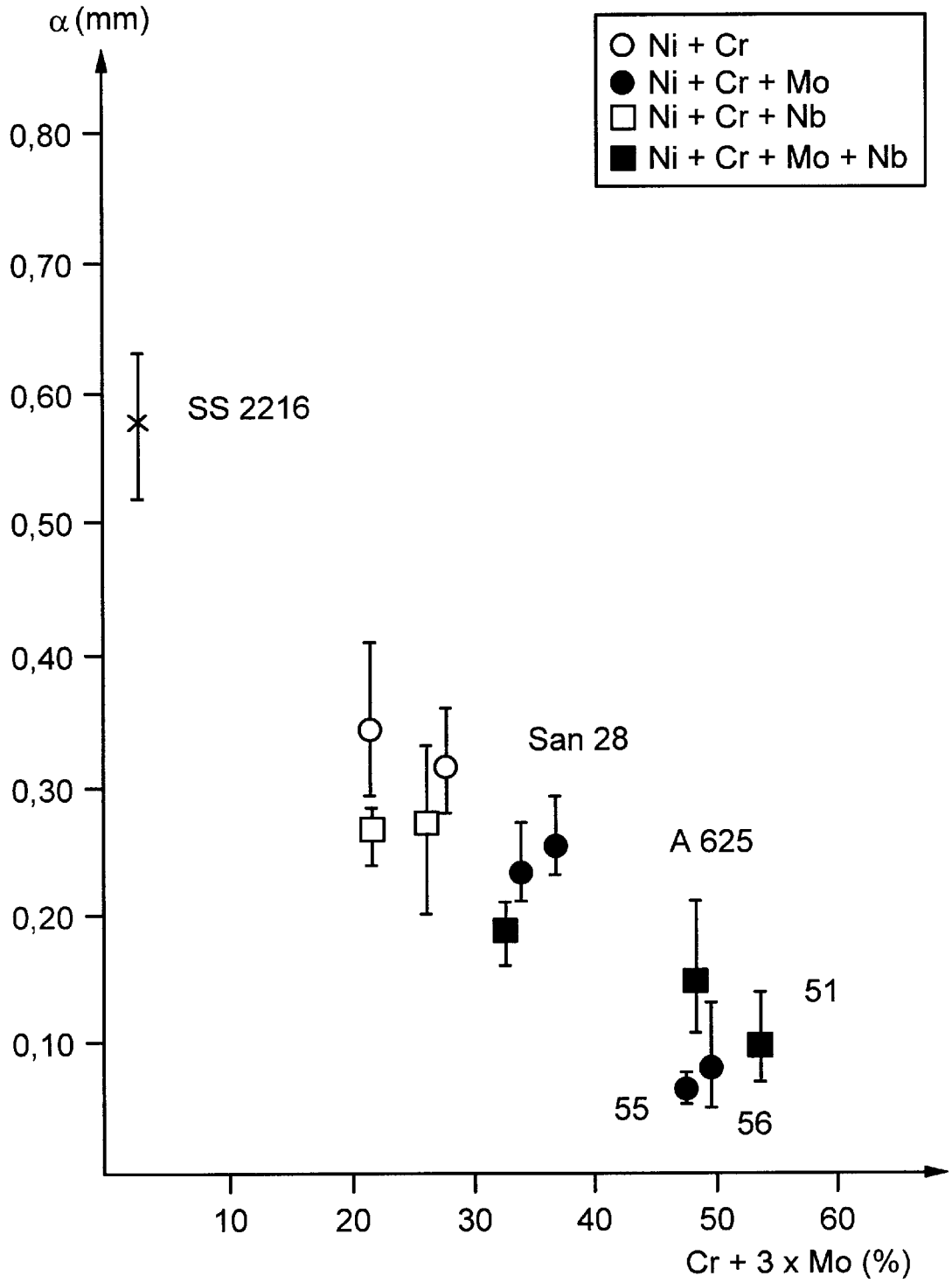
FIG. 1 is a graph of corrosion test results of alloys in accordance with the invention and comparative alloys wherein average loss of material $\alpha$ (mm) is plotted versus Cr+3×Mo (%)

According to a preferred embodiment, the invention provides a Ni-based alloy having an austenitic microstructure and containing, in weight-%:

| | | |
|---|---|---|
| C | up to | 0.025%, |
| Cr | | 20–27, |
| Mo | | 8–12, |
| N | up to | 0.10, |
| Fe | | 3–15, |
| Ti | up to | 0.5, |
| Nb | " | 0.5, |
| Si | " | 0.5, |
| Mn | " | 0.5, |
| Al | " | 0.3, |
| Ni | remainder (except normal impurities), and | |

Cr and Mo being present in amounts such that $45 \leqq (\%\ Cr)+3\times(\%\ Mo) \leqq 57$. In addition, Ti and N are preferably present in amounts such that $$\frac{Ti}{N}$$

Further details and advantages of the present invention will appear from the following description of an extensive test program that has been carried out.

Bar samples were made out of selected test alloys. The manufacture included ingot casting, extrusion and heat treatment. During extrusion the alloys were subjected to a reduction of diameter from 77 mm to 38 mm. Test samples were taken out of each bar, subjected to hot workability testing (Gleeble) tensile strength testing, thermal analysis and corrosion testing in a full scale plant for waste incineration. These tests were also used to evaluate actually installed tubes made of Sanicro 28 and A 625.

Table 1 below shows the chemical analysis (in weight %) of the investigated test alloys which have been subjected to all three of the above mentioned test procedures. The first alloy in Table 1 is designated SS 2216 which is a low alloy superheater steel corresponding to international standard ASTM SA213-T12. The second alloy is an alloy developed by the assignee of the present invention and marketed as Sanicro 28 which corresponds with international designation UNS 08028. The third alloy is a commercially available alloy called A 625 with international designation UNS 06625. The alloys following thereafter in the table are test alloys made for this investigation, and referred to in the following description with reference to the two last digits (e.g., Sanicro 63×51 is hereinafter referred to as alloy 51). The analysis of these test alloys has been varied such that the impact of Fe, Cr, Ni, Nb and Mo can be studied more closely.

TABLE 1

| Alloy | C | Si | Mn | Ti | Al | N | Cr | Ni | Mo | Nb | Fe |
|---|---|---|---|---|---|---|---|---|---|---|---|
| SS 2216 | 0.12 | 0.25 | 0.50 | — | — | — | 0.95 | — | 0.55 | — | 97.5 |
| Sanicro 28 | 0.01 | 0.45 | 1.7 | — | — | 0.03 | 26.7 | 30.6 | 3.3 | — | 37.1 |
| A 625 | 0.036 | 0.11 | 0.32 | 0.34 | 0.22 | 0.013 | 21.8 | 61.2 | 8.8 | 3.8 | 2.8 |
| Sanicro 63X51 | 0.028 | 0.20 | 0.27 | 0.26 | 0.15 | 0.020 | 32.0 | 51.6 | 7.2 | 2.1 | 6.2 |
| Sanicro 63X52 | 0.029 | 0.19 | 0.23 | 0.28 | 0.24 | 0.008 | 11.5 | 72.3 | 7.0 | 2.1 | 6.0 |
| Sanicro 63X53 | 0.033 | 0.22 | 0.26 | 0.34 | 0.27 | 0.016 | 21.8 | 62.7 | — | 3.7 | 10.7 |
| Sanicro 63X54 | 0.030 | 0.22 | 0.26 | 0.31 | 0.24 | 0.007 | 26.1 | 65.9 | — | 3.8 | 3.1 |
| Sanicro 63X55 | 0.030 | 0.21 | 0.27 | 0.29 | 0.20 | 0.008 | 21.8 | 62.8 | 8.6 | — | 6.2 |
| Sanicro 63X56 | 0.029 | 0.23 | 0.27 | 0.29 | 0.19 | 0.008 | 23.7 | 63.8 | 8.6 | — | 2.7 |
| Sanicro 63X57 | 0.031 | 0.23 | 0.26 | 0.32 | 0.22 | 0.005 | 21.6 | 63.0 | — | — | 14.3 |
| Sanicro 63X58 | 0.029 | 0.27 | 0.23 | 0.30 | 0.18 | 0.007 | 27.7 | 68.5 | — | — | 2.7 |
| Sanicro 63X59 | 0.029 | 0.24 | 0.25 | 0.32 | 0.20 | 0.011 | 22.1 | 61.6 | 4.0 | — | 11.1 |

The corrosion tests were carried out by mounting the various alloys on a cooled testing probe. These probes were thereafter located in the superheater section in a waste incinerator. The probe testing was done such that temperatures of the materials being tested were 450° C. during 90 days and 500° C. during 45 days, altogether in four test runs, and the average loss of material $\alpha$ (mm) was measured, based on eight crossections around the samples circumference. The internal corrosion attacks were found to be negligible. The results from 500° C. testing is shown in FIG. 1.

The following conclusions were made:

Nb, Fe and Ni had no significant effect on corrosion rate within the studied alloy range. Cr and Mo had a positive effect on the corrosion rate, and alloys 51, 55 and 56 are at least comparable with alloy A 625 from a corrosive point of view. Other test alloys gave results worse than A 625 regarding corrosion rate.

A careful analysis of the corrosive data from probe testing of these alloys shows a proportional relation between (% Cr)+3 (% Mo) and corrosion rate $\beta$. This means that $\beta=-k_1\times(\%\ Cr)+3\ (\%\ Mo)+k_2$. An increase of (% Cr)+3 (% Mo) gives an almost linear reduction in corrosion rate.

In order to investigate the corrosion resistance samples in the form of rings were manufactured out of extruded bar from the test alloys. The results are shown in Table 2. Large differences in hot workability were observed, during extrusion wherein the extrusion temperature was 1130° C. in all cases.

TABLE 2

| Alloy | Max-force (bar) | Appearance |
|---|---|---|
| 51 | 120 | Many surface cracks |
| 52 | 130 | " |
| 53 | 115 | " |
| 54 | 110 | " |

TABLE 2-continued

| Alloy | Max-force (bar) | Appearance |
|---|---|---|
| 55 | 130 | A few surface cracks |
| 56 | 130 | " |
| 57 | 95 | Minor surface cracks |
| 58 | 100 | " |
| 59 | 110 | " |

From the above it appears that Nb has a negative effect on hot workability as regards crack formation. It also appears that Mo, to a certain extent, will increase the deformation force needed. Inspection of the material after extrusion has shown that the Nb-alloyed variants 51, 52, 53 and 54 appeared to have a larger number and deeper surface cracks than those alloys that are not alloyed with Nb.

In order to provide a larger amount of test alloys for the testing of hot workability and strength the number of alloys was increased, beyond those in Table 1, to include also those in Table 3 below.

TABLE 3

| Alloy | C | Si | Mn | Ti | Al | N | Cr | Ni | Mo | Nb | Fe | Cu |
|---|---|---|---|---|---|---|---|---|---|---|---|---|
| Sanicro 63X61 | 0.007 | 0.31 | 0.30 | 0.26 | 0.15 | 0.038 | 25.6 | 55.3 | 6.1 | — | 9.8 | 2.0 |
| Sanicro 63X62 | 0.005 | 0.42 | 0.34 | 0.21 | 0.10 | 0.034 | 29.6 | 53.1 | 6.2 | — | 10.1 | — |
| Sanicro 63X63 | 0.005 | 0.33 | 0.29 | 0.22 | 0.15 | 0.022 | 25.5 | 53.6 | 10.1 | — | 9.9 | — |
| Sanicro 63X64 | 0.008 | 0.29 | 0.31 | 0.24 | 0.14 | 0.018 | 20.5 | 56.5 | 12.2 | — | 9.8 | — |
| Sanicro | 0.007 | 0.32 | 0.30 | 0.24 | 0.15 | 0.023 | 25.4 | 51.7 | 12.2 | — | 9.7 | — |

TABLE 3-continued

| Alloy | C | Si | Mn | Ti | Al | N | Cr | Ni | Mo | Nb | Fe | Cu |
|---|---|---|---|---|---|---|---|---|---|---|---|---|
| 63X65 Sanicro 63X66 | 0.008 | 0.32 | 0.30 | 0.23 | 0.13 | 0.012 | 15.2 | 58.5 | 15.0 | — | 10.1 | — |

Hot workability testing (Gleeble) was carried out on all alloys, i.e. Sanicro 28, A 625 and alloys 51–59 and 61–66.

Figure 2:
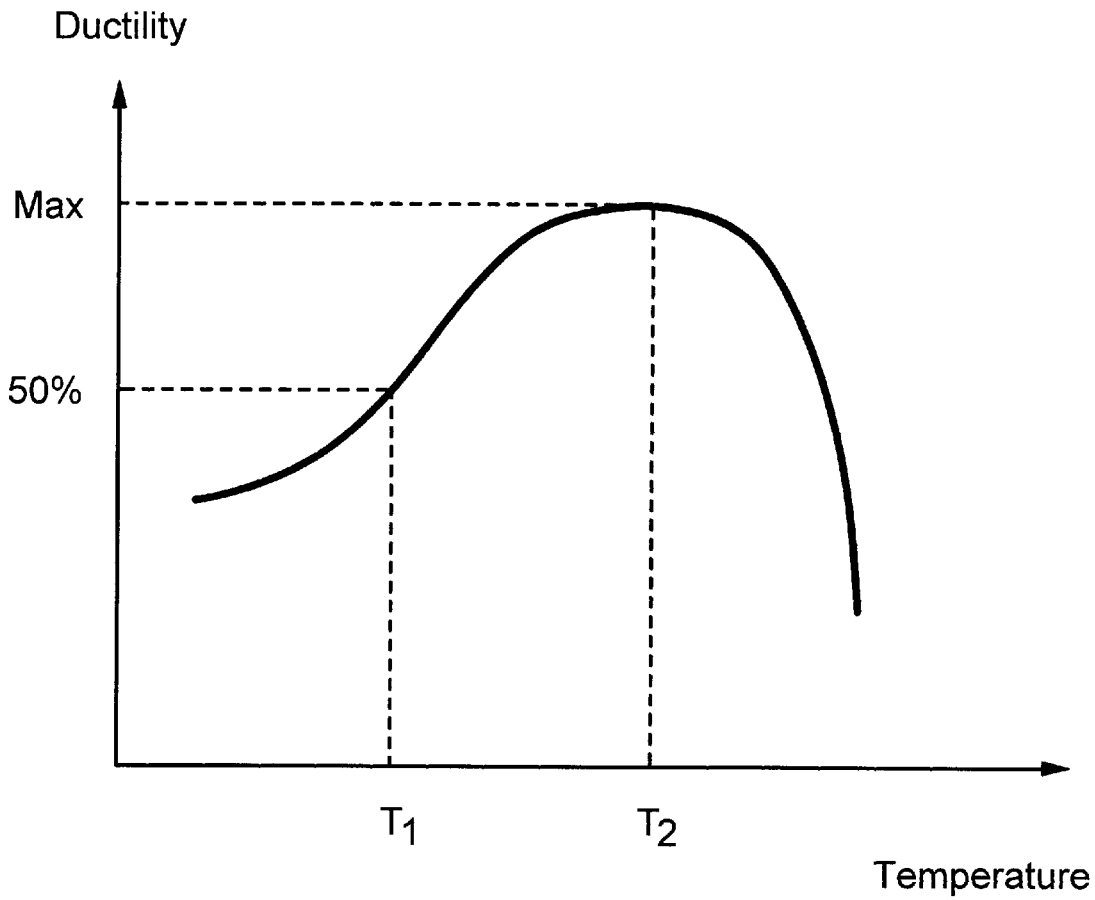
FIG. 2 shows the results of a Gleeble test wherein ductility versus temperature is plotted.
Figure 3:
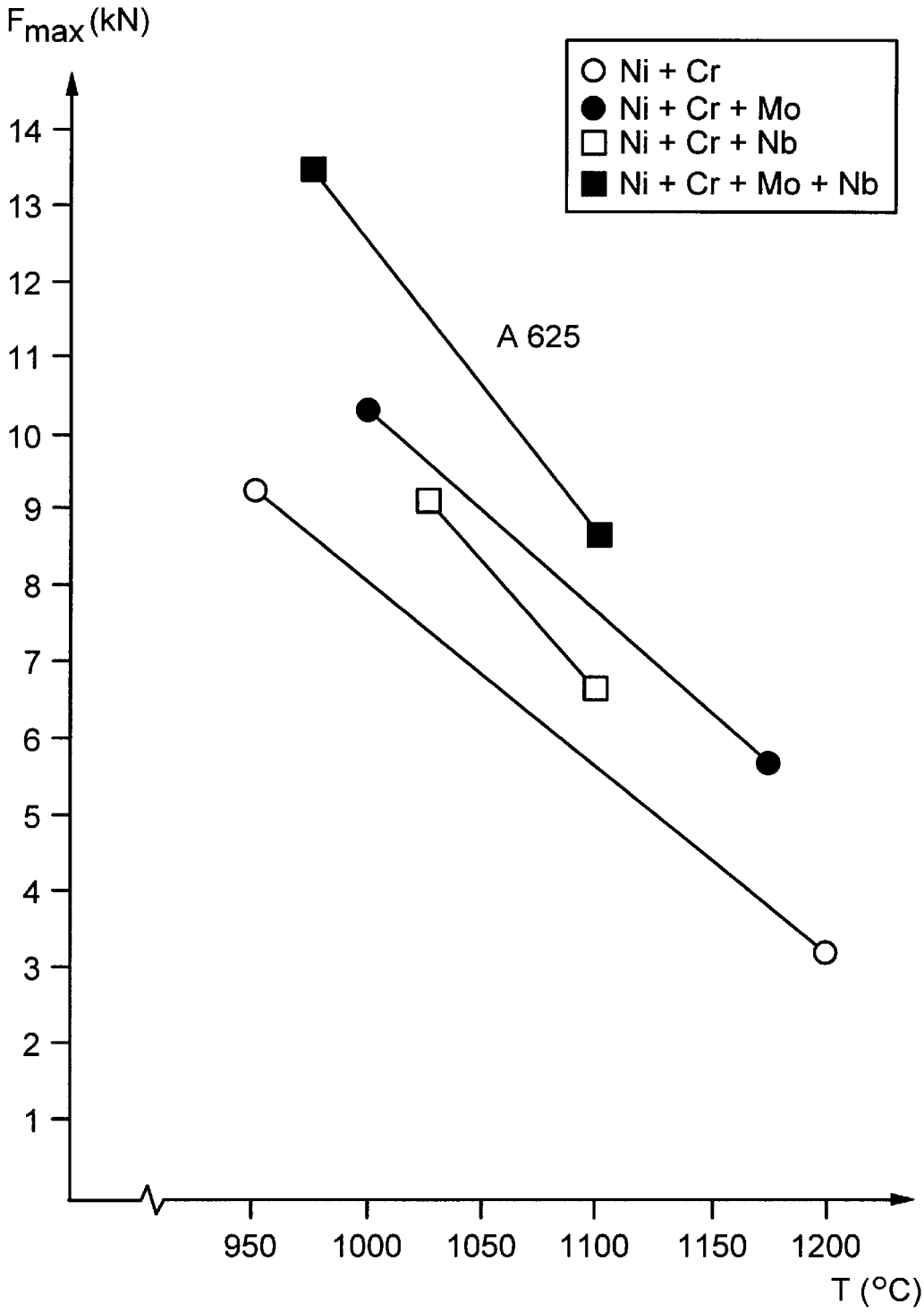
FIG. 3 is a graph of force $F_{max}$ (kN) needed for forming at high temperatures versus temperature T (°C.)
Figure 4:
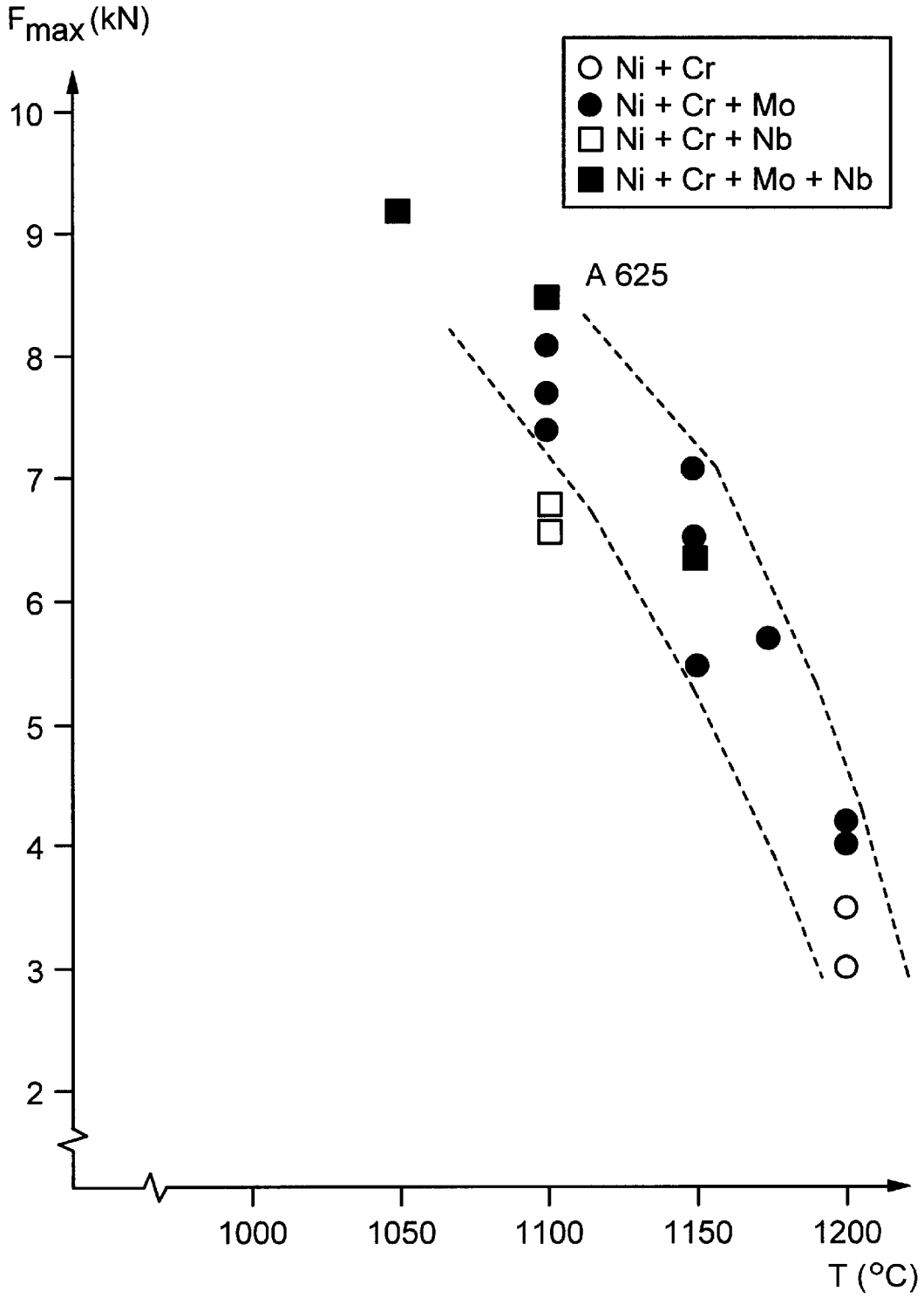
FIG. 4 is a graph showing maximum deformation force $F_{max}$ (kN) at maximum ductility.

As a basis for studying the force needed for forming at high temperatures, the Gleeble-curves produced by the Gleeble testing were evaluated as shown in FIG. 2 wherein a temperature marking has been made at 50% ductility ($T_1$) and one at the maximum ductility ($T_2$). The force for the respective Gleeble-curves is measured at positions $T_1$ and $T_2$ and a straight line is drawn between these two points, as illustrated in FIG. 3. What appears from FIG. 3 is an essential reduction of the deformation force needed for hot working alloys that do not contain any Nb in comparison with A 625. The reduction of force due to the exclusion of Nb is largely associated with an increase of solidus temperature and upper hot working limit which enables hot-working to occur at a higher temperature where the deformation resistance is lower. FIG. 4 shows maximum deformation force $F_{max}$ (kN) at maximum ductility.

Figure 5:
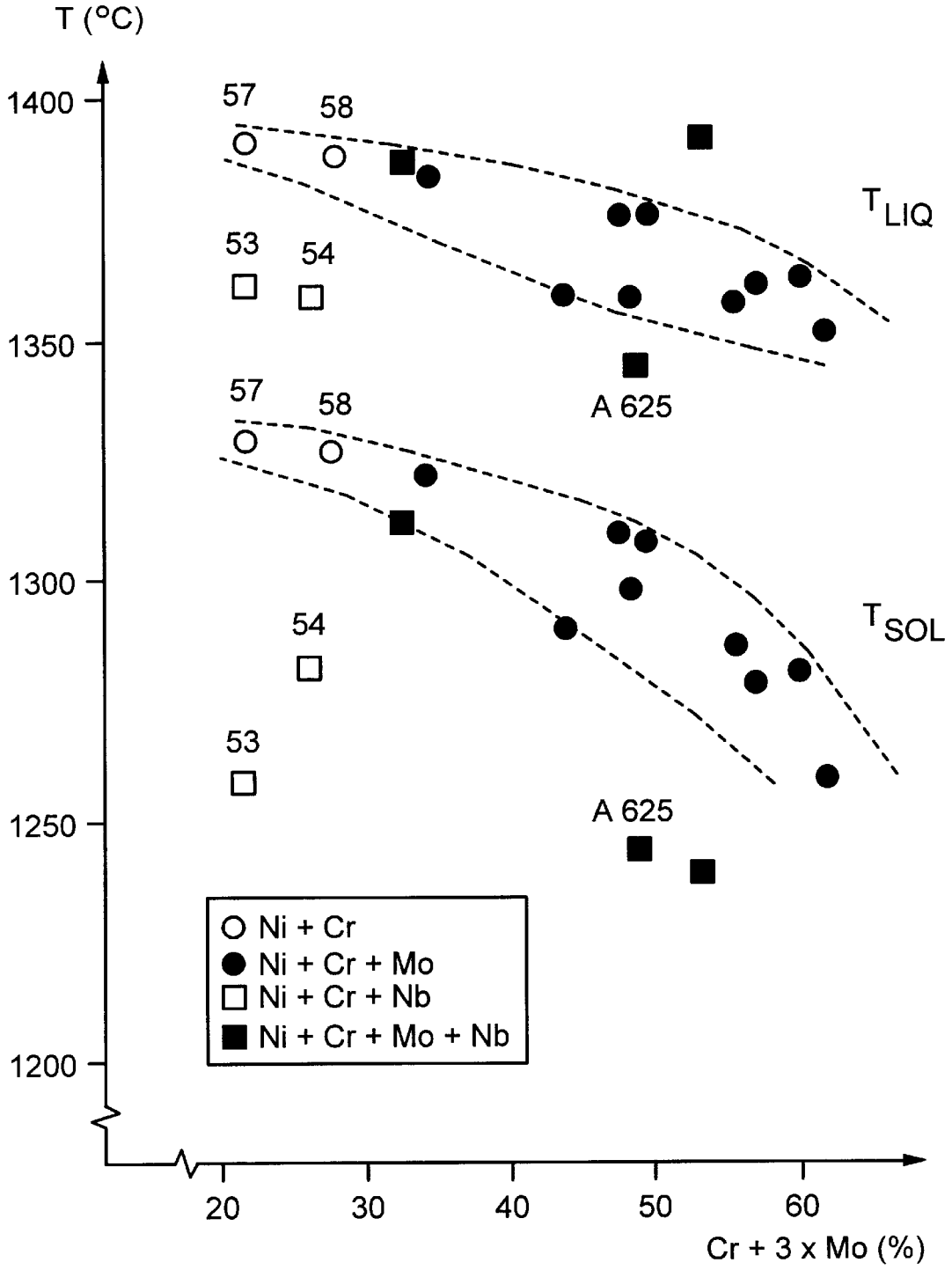
FIG. 5 shows solidus and liquidus lines for alloys 51–59 and 61–66.
Figure 6:
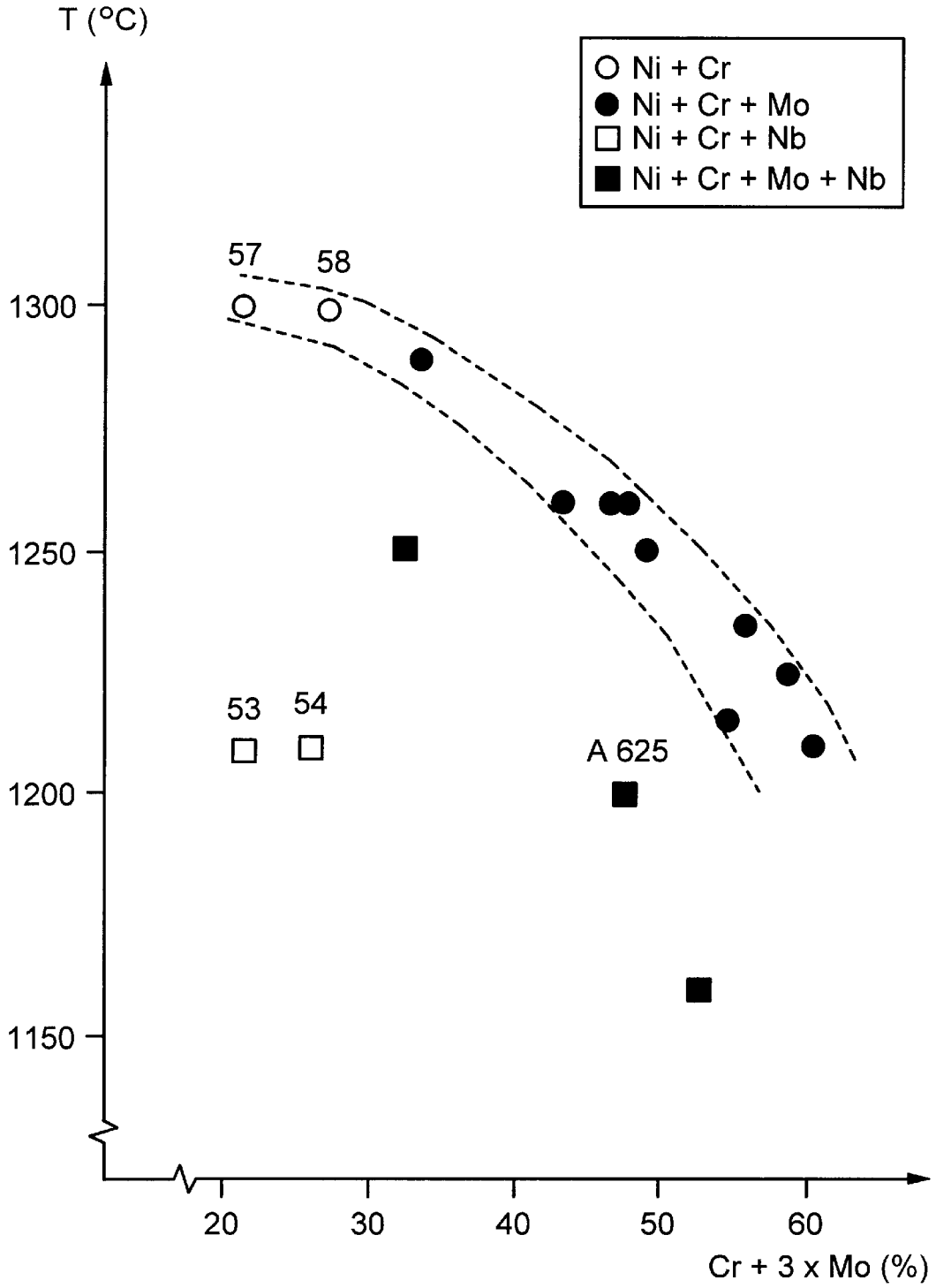
FIG. 6 shows the upper hot working limit from Gleeble-testing.

FIG. 5 shows solidus and liquidus lines for alloys 51–59 and 61–66. For the alloys that are not alloyed with Nb a correlation can be seen between these temperatures and the value (% Cr)+3 (% Mo). From experience, it is desirable from a hot working perspective to keep the solidus temperature above 1300° C. FIG. 6 shows the upper hot working limit from Gleeble-testing and defined as the temperature at which ductility approaches down to 0%. As shown in FIG. 6, a correlation can again be seen between the upper hot working limit and (% Cr)+3 (% Mo) for the alloys that do not contain any Nb. FIGS. 4 and 5 show the unfavorable effect of adding Nb from a hot workability point of view (e.g., compare also alloys 53 and 54 with 57 and 58).

Figure 7:
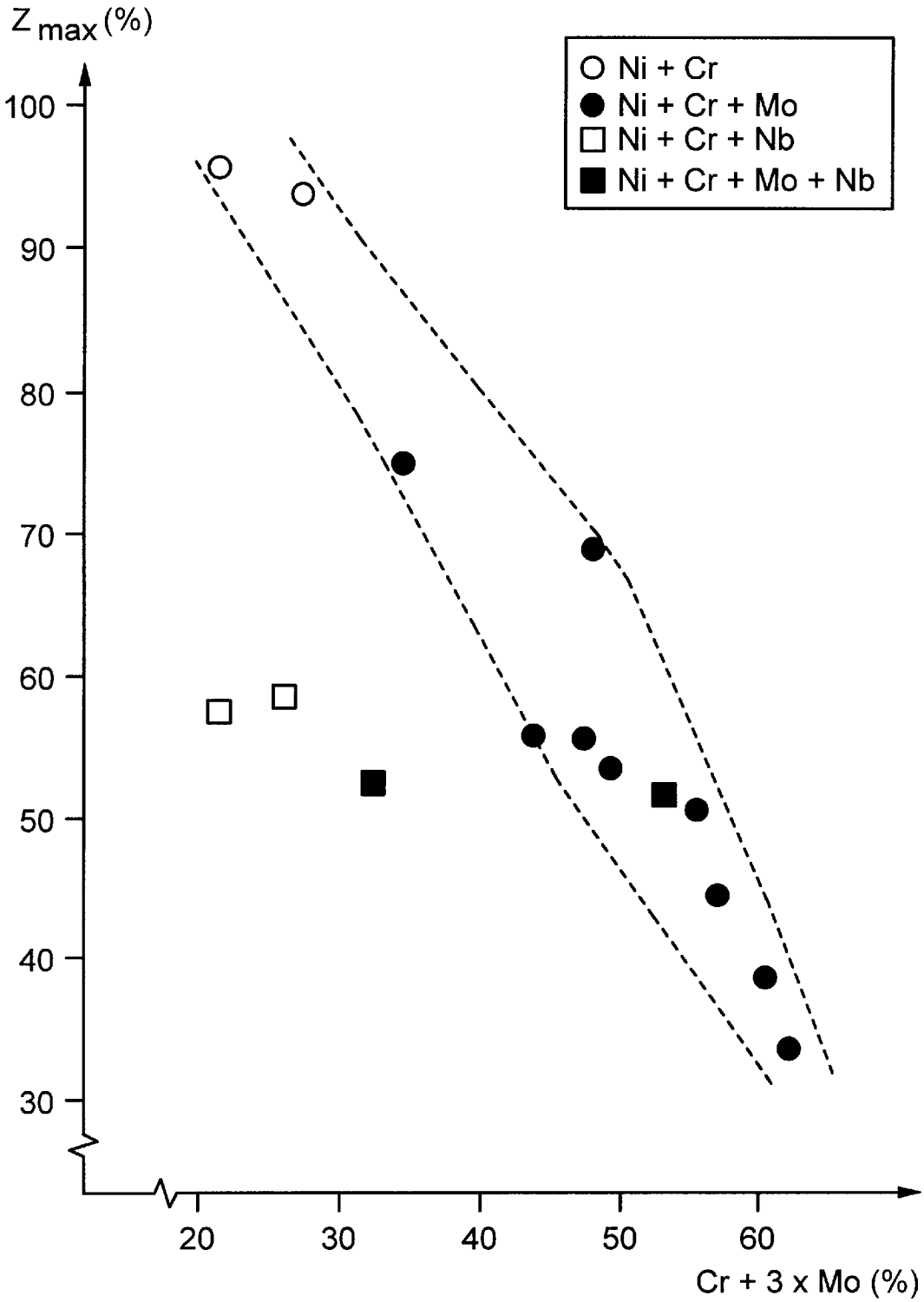
FIG. 7 shows the effect of Mo and Nb upon the contraction $Z_{max}$ (%)

FIG. 7 shows the effect of Mo and Nb upon the contraction $Z_{max}$ (%). It appears therefrom that Mo- and Nb-contents have a negative effect on ductility. Also in this case the correlation to (% Cr)+3 (% Mo) can be seen for the alloys that do not contain any Nb.

Hence, the tests that were carried show that Nb has a negative effect on the upper hot working limit and also upon maximum ductility. Mo has same negative effect upon ductility but essentially smaller effect on the upper hot working limit than Nb.

Figure 8:
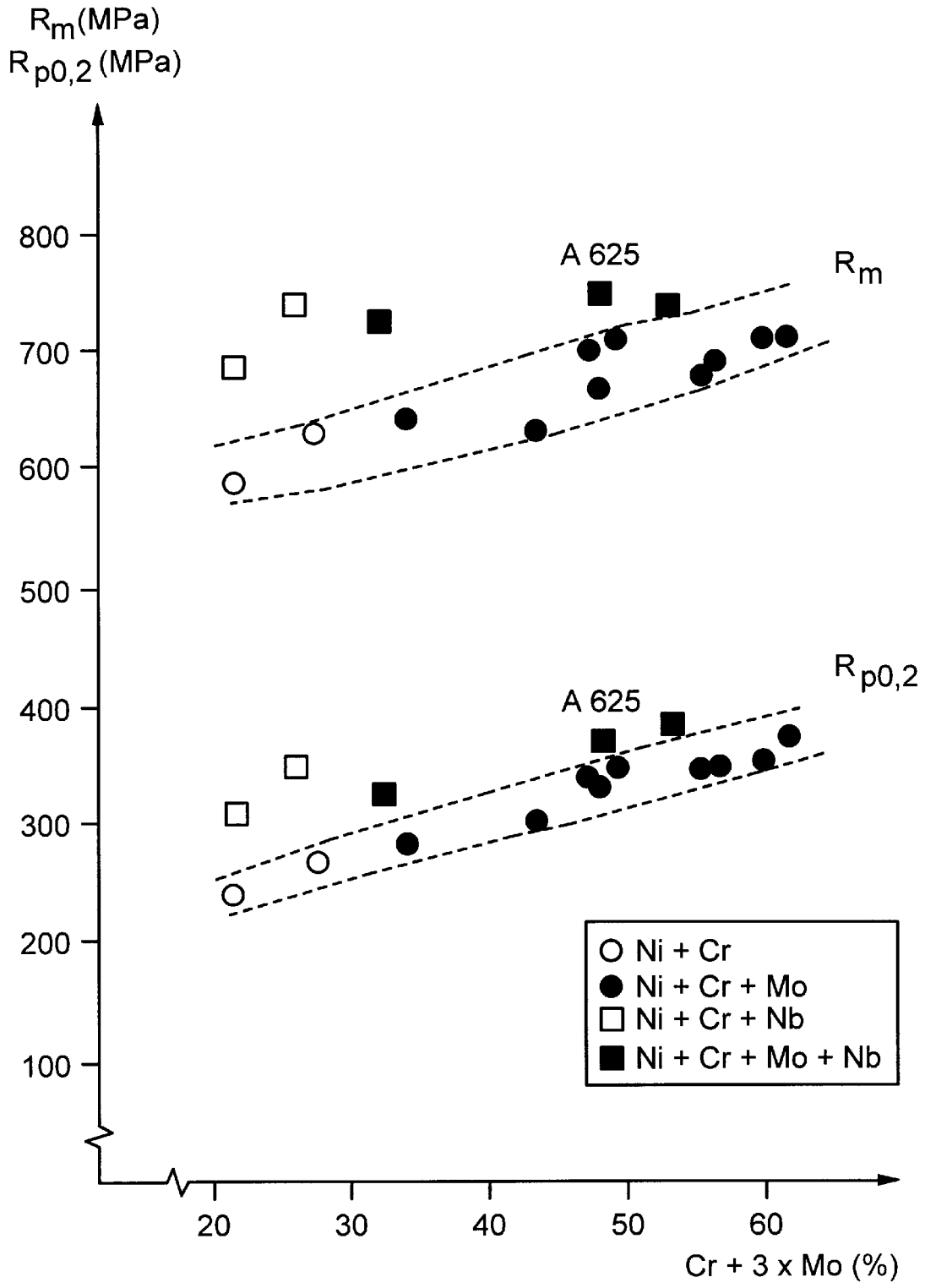
FIG. 8 shows ultimate tensile strength and yield strength for alloys in accordance with the invention and comparative alloys.

Tensile strength testing has been carried out on alloys 51–59 and 61–66. Ultimate tensile strength $R_m$ and yield strength $R_{p\ 0.2}$ are illustrated in FIG. 8. The following condition is valid for the alloy variants that do not contain Nb:

$R_m \approx$(% Cr)+3 (% Mo), where $R_m$ is ultimate tensile strength (MPa)

$R_{p\ 0.2} \approx$(% Cr)+3 (% Mo), where $R_{p\ 0.2}$ is yield strength (at a permanent elongation of 0.2%).

It also appears that the materials with Nb have higher values for $R_{p\ 0.2}$ and $R_m$ at the same value for (% Cr)+3 (% Mo). In other words, at a given value for (% Cr)+3 (% Mo) the value for $R_{p\ 0.2}$ is higher when adding Nb. A lower value for $R_{p\ 0.2}$ is of advantage for cold working.

Figure 9:
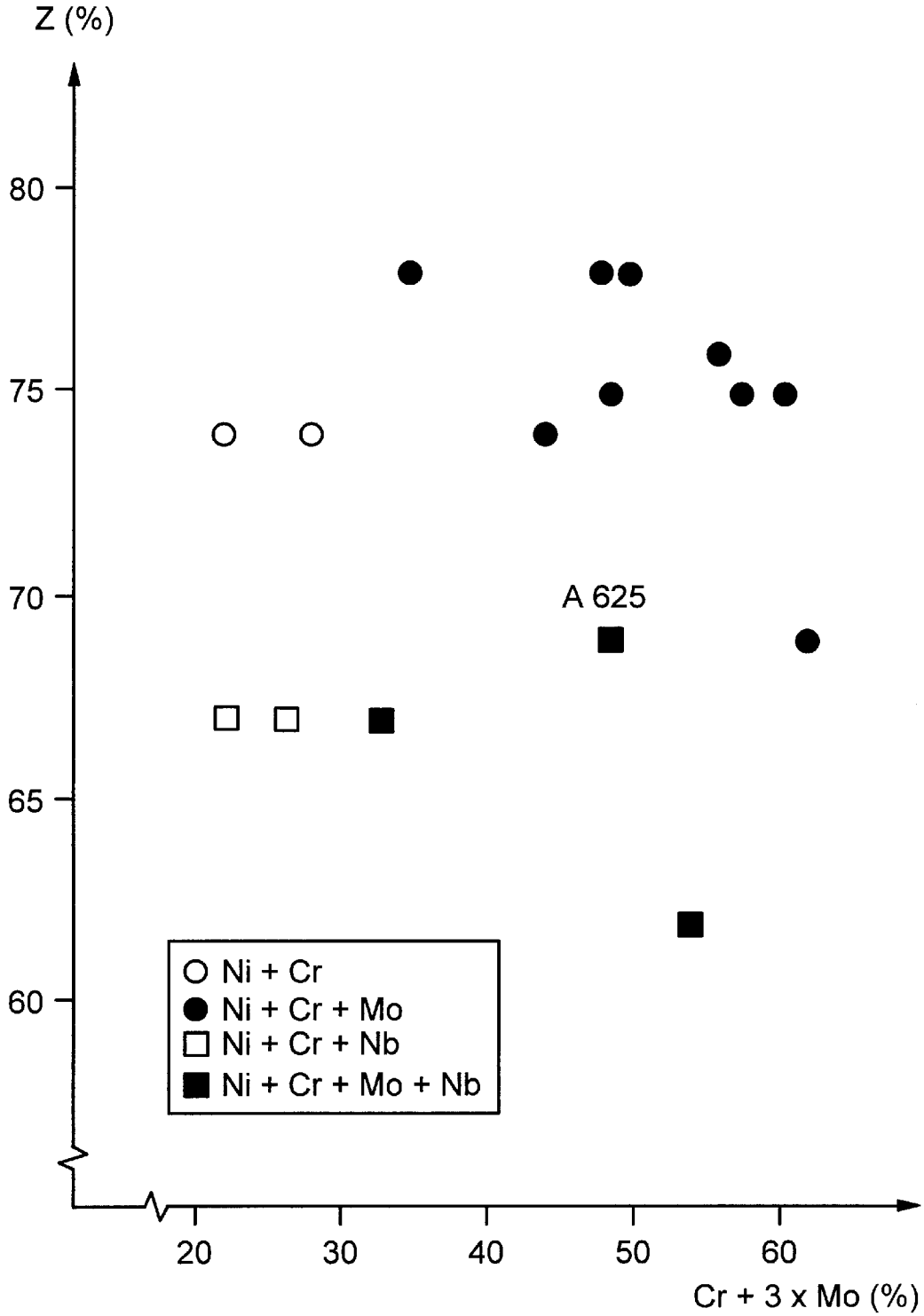
FIG. 9 shows contraction Z (%) as a function of Cr+3×Mo.

In FIG. 9 measured contraction Z (%) is shown as a function of (% Cr)+3 (% Mo). A remarkable difference appears between alloys with Nb as compared with alloys without Nb. In the test alloys without Nb an essential reduction of grain boundary precipitations has been observed. This is related to the fact that Nb (C, N) is not formed. During heat treatment Nb additions can cause additional precipitation and form a large volume fraction of $Nb_6$ (C, N). Hence, alloys without Nb give a significant reduction of unstable grain boundary precipitation which indicates that very good structure stability has been achieved.

From these observations it appears that it is advantageous if Nb is not present in the alloy since it gives no positive effect upon corrosion properties but rather a negative effect on primarily hot workability. The further conclusion that can be drawn is that it is more favorable from a corrosion resistance point of view to maximize the value for (% Cr)+3 (% Mo) whereas it is of advantage from a hot workability point of view to minimize (% Cr)+3 (% Mo). An optimum analysis from manufacturing and corrosion perspectives is achieved by defining the condition 45≦(% Cr)+3 (% Mo)≦57. At the same time the Nb-content ought to be max 0.5%. The content of Si should preferably be selected within the range 0.20–0.40%.

In order to find an analysis that is balanced from a structure stability perspective the content of C should be max 0.025% and the content of Fe should be 3–15%, preferably 3–12%, and more preferably 4–8%. At the same time the amounts of Ti and N should be selected such that the condition $$\frac{Ti}{N}$$

1.5 is fulfilled.

The desired contents of for C, Ti and N is related to the tendency for precipitation. The content of Fe should be maximized to 15%, preferably to 12% in order to obtain good stability towards sigma phase formation.

The Cr-content should preferably be 20–24% and the Mo-content should preferably be 8–10%. Other elements should be present in amounts less than 0.5%.

Such an alloy has optimum properties with regard to corrosion in relation to hot workability, tensile strength and good structure stability. The analysis such as outlined above results in a material that from a workability point of view is much better than A 625 but equally comparable from a corrosive point of view.

Thus, the material according to the invention will be suitable for use in heat exchanger tubes in power boilers which are exposed to sulphur, chloride or alkaline containing environments which could result in high temperature corrosion.

Preferable applications include usage as superheater tubes and boiler tubes in power boilers for municipal and industrial waste incineration.

The material according to the invention is well suitable for use in heat exchangers used at material temperatures of 300–550° C. which are exposed to high temperature corrosion. In a preferred embodiment the material of this invention is used as material in the outer layer of a composite tube consisting of two tube components metallurgically bonded to each other by coextrusion where the inner component consists of a conventional carbon steel (such as SA210A1 ) or a low alloy pressure vessel steel (SA213-T22).

It is to be understood that, as an alternative, monotubes could be made of this Ni-based alloy for the purpose of being used in the above defined application areas.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. In a heat exchanger unit exposed to sulphur-, chloride-, or alkaline-containing environments at temperatures of 300 to 550° C., the tubes of the heat exchanger comprising seamless tubes of an austenitic Ni-based alloy having good workability, good corrosion resistance and good structure stability comprising, in weight %:

| | | |
|---|---|---|
| C | up to | 0.025%. |
| Cr | | 20-27%. |
| Mo | | 8–12% |
| Si | up to | 0.5%. |
| Mn | up to | 0.5%. |
| Al | up to | 0.3%. |
| N | up to | 0.1%. |
| Fe | | 3–15% |
| Ti | up to | 0.5% |
| Nb | up to | 0.5%. |

and a balance of the alloy being Ni and unavoidable impurities with Cr and Mo being present in amounts such that $45 \leqq (\%\ Cr)+3(\%\ Mo) \leqq 57$.

2. In a method of generating power in a power boiler for municipal and industrial waste incinerators, the power being generated by passing a fluid heat exchange medium through seamless tubes, the tubes comprising superheater tubes of the power boiler, the tubes made of an austenitic Ni-based alloy having good workability, good corrosion resistance and good structure stability, the alloy comprising, in weight %:

| | | |
|---|---|---|
| C | up to | 0.025%. |
| Cr | | 20–27%. |
| Mo | | 8–12%. |
| Si | up to | 0.5%. |
| Mn | up to | 0.5%. |
| Al | up to | 0.3%. |
| N | up to | 0.1%, |
| Fe | | 3–15%. |
| Ti | up to | 0.5% |
| Nb | up to | 0.5% |

and a balance of the alloy being Ni and unavoidable impurities with Cr and Mo being present in amounts such that $45 \leqq (\%\ Cr)+3(\%\ Mo) \leqq 57$.

3. The method according to claim 2, wherein said Ni-based alloy tubes are exposed to elevated temperatures of 300–550° C.

4. In a method of generating power in a power boiler for municipal and industrial waste incinerators, the power being generated by passing a fluid heat exchange medium through seamless tubes, the tubes comprising boiler tubes of the power boiler, the tubes made of an austenitic Ni-based alloy having good workability, good corrosion resistance and good structure stability, the alloy comprising, in weight %:

| | | |
|---|---|---|
| C | up to | 0.025%. |
| Cr | | 20–27%. |
| Mo | | 8–12%. |
| Si | up to | 0.5%. |
| Mn | up to | 0.5%. |
| Al | up to | 0.3%. |
| N | up to | 0.1%. |
| Fe | | 3–15%. |
| Ti | up to | 0.5%. |
| Nb | up to | 0.5% |

and a balance of the alloy being Ni and unavoidable impurities with Cr and Mo being present in amounts such that $45 \leqq (\%\ Cr)+3(\%\ Mo) \leqq 57$.

* * * * *